United States Patent [19]

Paley

[11] Patent Number: 4,895,259

[45] Date of Patent: Jan. 23, 1990

[54] COLLAPSIBLE COMPARTMENTED CARTON

[75] Inventor: Sandra D. Paley, Cuyahoga, Ohio

[73] Assignee: Container Corporation of America, Clayton, Mo.

[21] Appl. No.: 317,753

[22] Filed: Mar. 2, 1989

[51] Int. Cl.[4] ..... B65D 5/22

[52] U.S. Cl. ..... 206/565; 229/1.5 H; 229/164; 229/178; 229/904

[58] Field of Search ..... 206/561–563, 206/565; 229/1.5 H, 120.18, 120.21, 164, 178, 904

[56] References Cited

U.S. PATENT DOCUMENTS

| | | | |
|---|---|---|---|
| 2,355,206 | 8/1944 | Davidson, Jr. | 229/904 |
| 2,679,971 | 6/1954 | Goldberg | 206/563 |
| 2,924,372 | 2/1960 | Kirkeby | 206/563 |
| 3,366,303 | 1/1968 | Kaspar | 206/563 |
| 3,542,280 | 11/1970 | Crabtree | 206/563 |
| 3,899,119 | 8/1975 | Roccaforte | 206/563 |
| 4,262,804 | 4/1981 | Nelson, Jr. | 206/561 |
| 4,562,926 | 1/1986 | Mode | 206/563 |
| 4,778,055 | 10/1988 | Kiedaiseh | 206/563 |

*Primary Examiner*—Gary Elkins

*Attorney, Agent, or Firm*—Richard W. Carpenter

[57] ABSTRACT

A collapsible, self-locking carton, formed from a unitary blank of foldable paperboard, that is divided into two separate types of compartments for holding two different types of food items, one compartment having a horizontal wall with a central opening for holding a cylindrical item such as sauce cup, and the other component being a well with higher walls for holding taller elongated objects such as pretzels.

3 Claims, 2 Drawing Sheets

COLLAPSIBLE COMPARTMENTED CARTON

BACKGROUND OF THE INVENTION

1. Field of the Invention

This invention relates to folding cartons, and more particularly to a collapsible, self-locking, compartmented carton, formed from a unitary blank of foldable paperboard, for holding two different food products, such as pretzels and sauce.

2. Description of the Background Art

A search of the background art conducted in the United States Patent and Trademark Office disclosed the following United States Letters Patent:

| | | |
|---|---|---|
| 2,119,382 | 2,960,149 | 4,353,496 |
| 2,670,124 | 3,531,170 | 4,705,173 |
| 2,679,971 | 3,899,119 | 4,757,937 |
| 2,833,458 | 4,262,804 | |

None of the patents found in the search discloses a collapsible, self-locking carton with sloping rear and side walls, that is divided into separate types of compartments for holding two different types of food such as pretzels and sauce.

SUMMARY OF THE INVENTION

It is an object of the invention to provide a collapsible, self-locking, compartmented carton formed from a unitary blank of foldable paperboard.

A more specific object is to provide, in a carton of the type described, a compartment arrangement wherein one compartment is adapted to hold a cup of sauce and the other compartment has higher walls for holding elongated objects, such as pretzels.

These and other objects will become more apparent from an examination of the following description and drawings.

Figure 1:
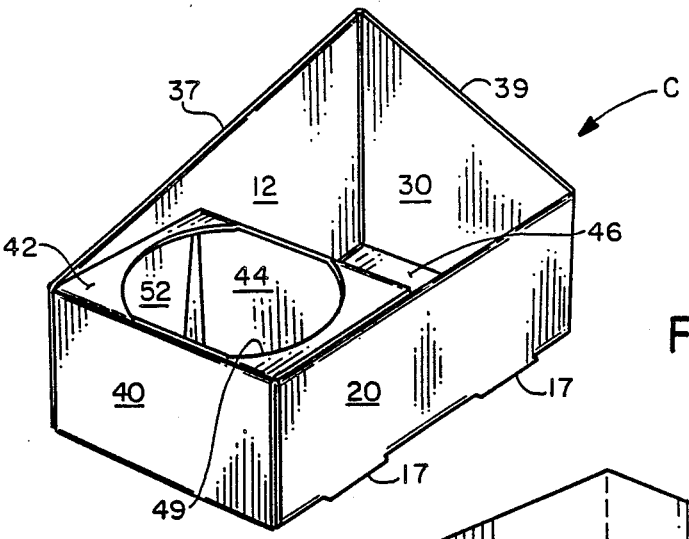
FIG. 1 is an isometric view of a carton embodying features of the invention, as shown in the erected condition.
Figure 3:
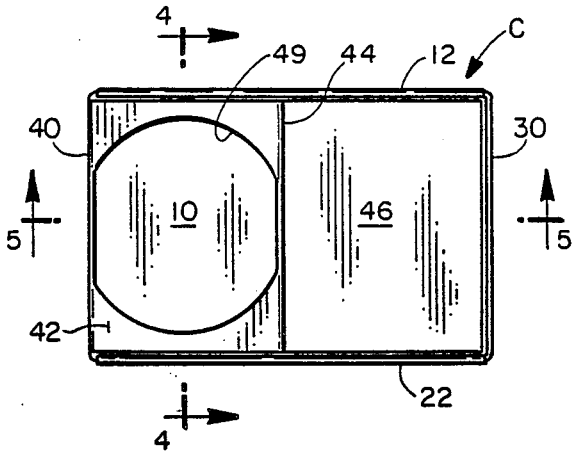
FIG. 3 is a top plan view if the structure illustrated in FIG. 1.
Figure 4:
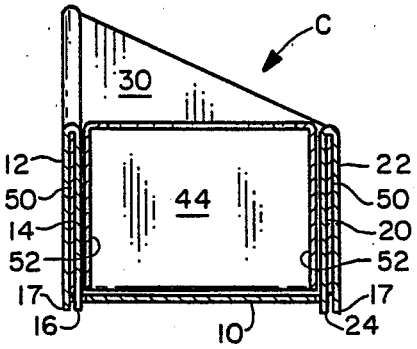
Figure 5:
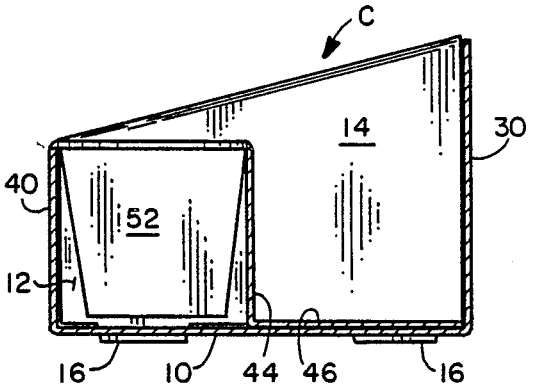
Figure 6:
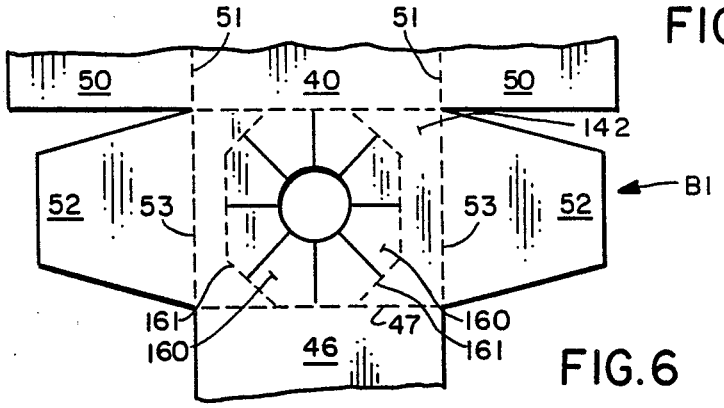

FIGS. 4 and 5 are vertical sectional views taken on lines 4—4 and 5—5, respectively, of FIG. 3, and FIG. 6 is a fragmentary view of a portion of the structure illustrated in FIG. 1, but showing a modified form of the invention.

It will be understood that, for purposes of clarity, certain elements may have been omitted intentionally from certain views where they are believed to be illustrated to better advantage in other views.

DESCRIPTION OF THE PREFERRED EMBODIMENT

Figure 2:
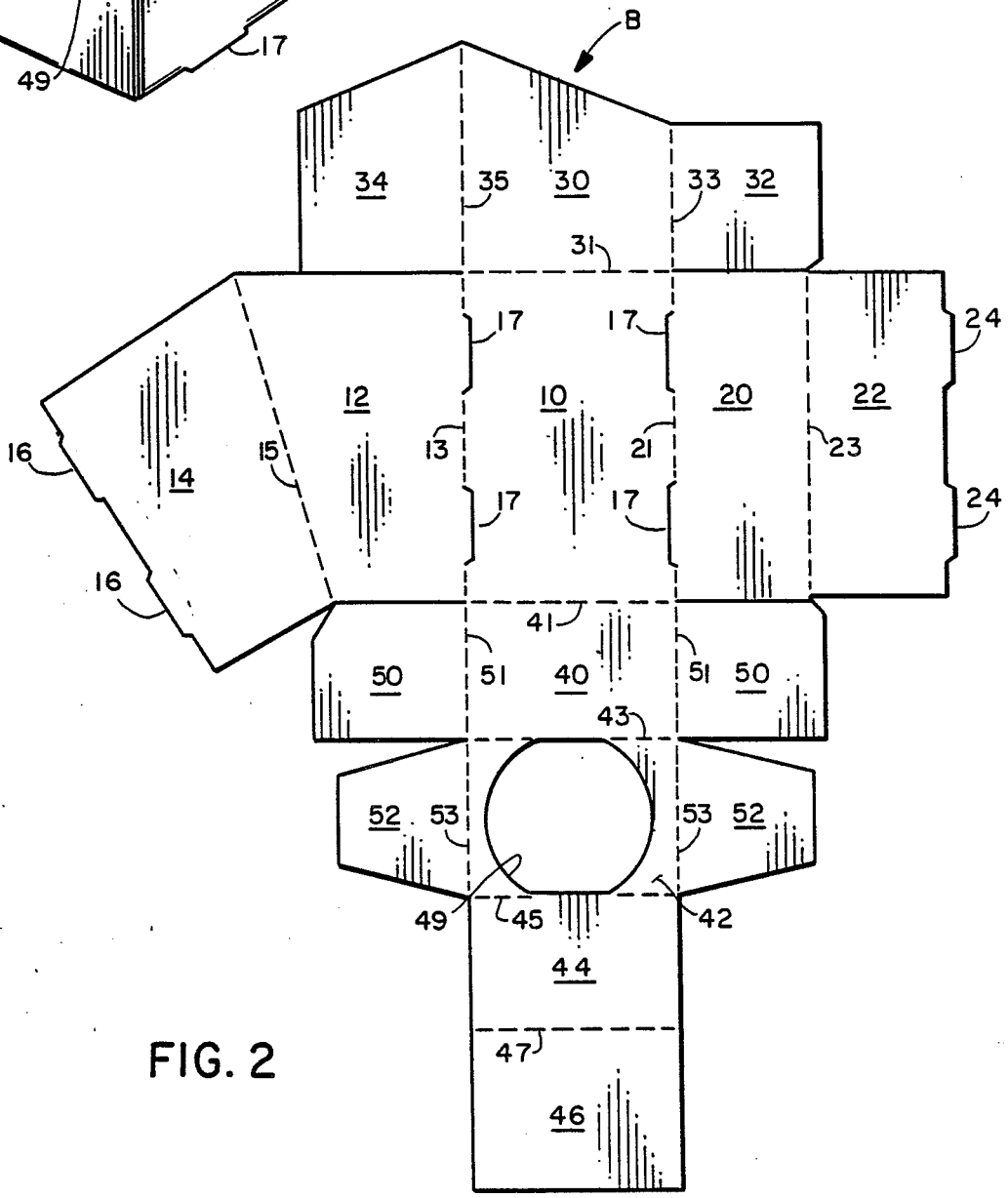
FIG. 2 is a plan view of a blank of foldable sheet material from which the carton illustrated in the other views may be formed.

Referring now to the drawings for a better understanding of the invention, It will be seen that the erected carton embodying features of the invention, and indicated at C in FIG. 1, may be formed from the unitary blank B of foldable paperboard illustrated in FIG. 2.

As best seen in FIGS. 1 and 2, Carton C includes a generally rectangular, oblong bottom wall panel 10, having opposed pairs of side and end walls upstanding therefrom.

The rear side wall includes an outer panel 12, foldably joined at a lower edge along a fold line 13 to the rear side edge of panel 10, and an inner panel 14 having an upper edge foldably joined to an upper edge of outer panel 12, and having, extending downwardly from a lower edge thereof a pair of Walker lock type tabs 16 adapted to be received within related slits 17 at the adjacent side edge of bottom wall panel 10.

The front side wall also includes an outer panel 20 foldably, joined at its lower edge on fold line 21 to a related side edge of bottom wall panel 10, and an inner panel 22, foldably joined at an upper edge on fold line 23 to an upper edge of outer panel 20, and having, extending downwardly from its lower edge a pair of lock tabs 24 adapted to be received with related slits 17 at the adjacent side edge of bottom wall panel 10.

The carton includes a pair of first and second end walls which comprise single end wall panels 30 and 40, respectively. First end wall panel 30 is foldably joined at its lower edge along a fold line 31 to one end edge of bottom wall panel 10, and has a pair of front and rear corner flaps 32 and 34 foldably joined to its front and rear side edges along fold lines 33 and 35, respectively.

Second end wall panel 40 is foldably joined at its lower edge along fold line 41, and it also has a pair of front and rear corner flaps 50 foldably joined to its fron and rear edges along fold lines 51.

The front and rear corner flaps of the end walls are adapted to be folded at right angles to the end walls and sandwiched between the outer and inner panels of the front and rear side walls, respectively, to maintain the carton in erected condition, without requiring and outside securing means, such as glue, tape, or staples.

It will be seen that first end wall panel 30 and its rear corner flap 34, as well as both rear side wall panels 12 and 14, are trapezoidal in shape; whereas first end wall panel front corner flap, the second side wall panel, both its corner flaps, and both panels of the front side wall are rectangular. This arrangement makes it possible to have one end wall and the rear side wall larger that the corresponding end and side walls, with the upper edges 37 and 39 of the rear wall and the first side wall sloping upwardly toward each other to provide support for taller elongated items contained in that corner of the carton, as explained hereinafter.

As previously mentioned, the carton has an interior compartment structure that permits the carton to hold two different types of food products separated from each other. The compartment structure includes a top wall panel 42 that is foldably joined at an outboard edge on fold line 43 to the adjacent upper edge of second end wall panel 40. Top wall panel is preferably one half of the length of bottom wall panel 10, and has a central opening 49 adapted to receive and retain a small cup of a food product, such as sauce or dip.

Top wall panel 42 is disposed in parallel relation with bottom wall panel 10 and is maintained in that position and supported from the bottom wall panel 10 by a divider panel 44, that is foldably joined to an inboard edge of top wall panel 42 and a pair of front and rear support flaps 52 that are foldably joined to front and rear side edges of top wall panel 42 on fold lines 53.

The divider panel and the support flaps 52 extend downwardly from the top wall panel to support it and to maintain it in proper position. The support flaps are disposed against the inner surfaces of the front and rear side wall inner panels.

The divider panel 44 not only helps support top wall panel 42, but it also serves to divide the interior of the carton into two separate compartments of approximately equal size. The divider panel is, in turn, maintained in proper vertical position by an anchor panel 46 that is foldably joined on fold line 47 at an inboard edge to the lower edge of the divider panel 44 and is disposed to lie flat on top of the inner surface of bottom wall panel 10 with the outboard edge of the anchor panel up against the inner surface of first end wall panel 30.

Turning now to FIG. 6 of the drawings, it will be seen that a slightly modified form of the invention is shown. In this embodiment all of the structure is the same as that of the previously described embodiment except that top wall panel 142 includes a plurality of radially disposed, generally wedge shaped tabs 160 foldably joined thereto on fold lines 161, and which may be depressed below the remainder of the top wall panel to provide an opening for receiving a cup of sauce or dip.

Thus, it will be understood that the invention provides a collapsible carton of unique design that is self-locking and is formed from a unitary blank of paperboard and which has two separate compartments, one of which has a wall with a central opening for receiving a cup of a liquid, such as a sauce, and the other of which is a well with some vertically extended walls for supporting taller elongated items such as pretzels.

What is claimed is:

1. An open top, tray type, compartmented carton, for serving separate food items such as pretzels and sauce, said carton being formed from a unitary blank of foldable paperboard and being self-locking so as not to require any outside securing means, said carton comprising:

(a) a generally rectangular, oblong, bottom wall panel having front and rear side walls and first and second end walls joined to and upstanding from front and rear side edges and first and second end edges, respectively;

(b) said front and rear side walls each including:

(i) an outer panel having a lower edge foldably joined to said bottom wall panel and having an upper edge;

(ii) an inner panel having an upper edge foldably joined to an upper edge of a related side wall outer panel, and having extending downwardly from a lower edge thereof at least one lock tab received within an opening in said bottom wall panel;

(iii) said rear side wall inner panel upper edge sloping upwardly from one of said end walls toward the other end wall;

(c) said end walls each including:

(i) a single panel having a lower edge foldably joined to an end edge of said bottom wall and having an upper edge;

(ii) said first end wall panel upper edge sloping upwardly from said front side wall toward said rear side wall;

(d) said end wall panels each having corner flaps foldably joined to opposite side edges thereof and inerposed between inner and outer panels of said front and rear side walls;

(e) an inner compartment structure including:

(i) a top wall panel having outboard and inboard end edges and front and rear side edges with said outboard edge foldably joined to said second end wall panel upper edge, said top wall panel extending inboardly from said second end wall over said bottom wall panel part way toward said first end wall panel, and having a central opening for receiving a food holding item such as a cup;

(ii) a pair of support flaps foldably joined to opposite side edges of said top wall panel and extending downwardly therefrom adjacent respective side walls to support said top wall panel;

(iii) a divider panel foldably joined to and extending downwardly from said top wall panel inboard edge to support said top wall panel and to divide the interior of said carton into separate compartments;

(v) an anchor flap having an end edge foldably joined to a lower edge of said divider panel and disposed to extend between said divider flap and said first end wall to maintain said divider panel in a generally vertical position.

2. A unitary blank of foldable paperboard for use in forming a collapsible, self-locking, compartmented carton, said blank being cut and scored to provide:

(a) a generally rectangular bottom wall panel;

(b) front and rear side wall outer panels having inboard side edges foldably joined to front and rear side edges, respectively, of said bottom wall panel and having outboard side edges;

(c) front and rear side wall inner panels having inboard edges foldably joined to adjacent outboard edges of respective front and rear side wall outer panels and having outboard edgea with lock tabs projecting outboardly therefrom;

(d) said front side wall panels being rectangular and said rear side wall panels being trapezoidal;

(e) first and second end wall panels having inboard edges foldably joined to respective end edges of said bottom wall panel and having outboard edges;

(f) said first end wall panel being rectangular and said second end wall panel being trapezoidal;

(g) each of said end wall panels having front and rear corner flaps foldably joined to front and rear side edges thereof, respectively;

(h) said second end wall rear corner flap being trapezoidal;

(i) a top wall panel having a central opening extending therethrough, having an inboard edge foldably joined to an outboard edge of said first end wall panel, and having an outboard edge;

(j) support panels foldably joined to opposite front and rear side edges of said top wall panel;

(k) a divider panel having an inboard edge foldably joined to an outboard edge of said top wall panel and having an outboard edge;

(l) an anchor panel foldably joined to an outboard edge of said divider panel;

3. An open top, tray type, compartmented carton, for serving separate food items such as pretzels and sauce, said carton being formed from a unitary blank of foldable paperboard and being self-locking so as not to require any outside securing means, said carton comprising:

(a) a generally rectangular, oblong, bottom wall panel having front and rear side walls and first and second end walls joined to and upstanding from front and rear side edges and first and second end edges, respectively;

(b) said front and rear side walls each including:

(i) an outer panel having a lower edge foldably joined to said bottom wall panel and having an upper edge;

(ii) an inner panel having an upper edge foldably joined to an upper edge of a related side wall outer panel, and having extending downwardly from a lower edge thereof at least one lock tab received within an opening in said bottom wall panel;

(c) said end walls each including a single panel having a lower edge foldably joined to an end edge of said bottom wall and having an upper edge;

(d) said end wall panels each having corner flaps foldably joind to opposite side edges thereof and interposed between inner and outer panels of said front and rear side walls;

(e) an inner compartment structure including:

(i) a top wall panel having outboard and inboard end edges and front and rear side edges with said outboard edge foldably joined to said second end wall upper edge, said top wall panel extending inboardly from said second end wall over said bottom wall panel part way toward said first end wall panel, and having a central opening for receiving a food holding item such as a cup;

(ii) a divider panel foldably joined to and extending downwardly from said top wall panel inboard edge to support said top wall panel and to divide the interior of said carton into separate compartments;

(iii) an anchor flap having an end edge foldably joined to a lower edge of said divider panel and disposed to extend between said divider flap and said first end wall to maintain said divider panel in a generally vertical position;

(f) said rear side all inner panel and said first end wall panel having upper edges sloping upwardly toward each other.

* * * * *